US012075893B2

(12) United States Patent
Picchiotti

(10) Patent No.: US 12,075,893 B2
(45) Date of Patent: Sep. 3, 2024

(54) EXTENSIBLE ORNAMENTAL ITEM

(71) Applicant: Picchiotti S.r.l., Valenza AL (IT)

(72) Inventor: Giuseppe Picchiotti, Valenza AL (IT)

(73) Assignee: PICCHIOTTI S.R.L., Valenza Al (IT)

( * ) Notice: Subject to any disclaimer, the term of this patent is extended or adjusted under 35 U.S.C. 154(b) by 0 days.

(21) Appl. No.: 18/089,943

(22) Filed: Dec. 28, 2022

(65) Prior Publication Data

US 2023/0210229 A1 Jul. 6, 2023

(30) Foreign Application Priority Data

Dec. 30, 2021 (IT) ..... 102021000033125

(51) Int. Cl.
*A44C 5/08* (2006.01)
*A44C 5/00* (2006.01)

(52) U.S. Cl.
CPC ..... *A44C 5/0076* (2013.01); *A44C 5/08* (2013.01)

(58) Field of Classification Search
CPC ..... A44C 5/0076; A44C 5/08; A44C 5/0069; A44C 5/022
See application file for complete search history.

(56) References Cited

U.S. PATENT DOCUMENTS

| | | | | |
|---|---|---|---|---|
| 687,217 | A * | 11/1901 | Fritschle | A44C 5/08 132/75.4 |
| 1,660,438 | A | 2/1928 | Fielding | |
| 2,806,363 | A * | 9/1957 | Manne | A44C 9/02 63/5.2 |
| 10,271,619 | B1 * | 4/2019 | Peck | A44C 9/02 |
| 10,306,957 | B2 * | 6/2019 | Scandolaro | A44C 5/025 |
| 11,064,776 | B2 * | 7/2021 | Ostasz | A44C 9/02 |
| 11,116,292 | B2 * | 9/2021 | Demeglio | A44C 11/007 |
| 2016/0345690 | A1 | 12/2016 | Scandolaro | |
| 2022/0079303 | A1 * | 3/2022 | Bassan | A44C 11/007 |

OTHER PUBLICATIONS

IT Search Report dated Sep. 8, 2022; Application No. 102021000033125; 10 pages.

* cited by examiner

*Primary Examiner* — Jack W Lavinder
(74) *Attorney, Agent, or Firm* — Mark E. Bandy; Rankin Hill & Clark, LLP

(57) ABSTRACT

An extensible ornamental item comprising an annular element formed by a plurality of meshes and an elastic ring mounted passing through each mesh, each mesh having a female element and a male element constrained in a mutually movable manner to the male element and to the female element, respectively, of the two adjacent meshes, each male element comprising a tubular body provided with flaps comprising a slot, each female element comprising a central body, a circular hole, two circular openings and two pairs of pins. Each pin is adapted to engage in the respective slot of the male element.

10 Claims, 5 Drawing Sheets

EXTENSIBLE ORNAMENTAL ITEM

FIELD OF APPLICATION

The present invention relates to an extensible ornamental item.

DISCLOSURE OF THE PRIOR ART

An extensible ornamental item is known in the prior art comprising an elastic ring on which meshes are mounted which can slide therebetween and with respect to the elastic ring so as to modify the diameter of the ornamental item and adapt to that of the wrist of the user wearing the ornamental item. Each mesh consists of a male element and a female element constrained in a mutually movable manner with respect to the adjacent meshes. In particular, each male element comprises a slot and each female element comprises a side hole for a pin passing through said side hole and through the slot to limit the mutual distancing movement of the female element of a mesh from the male element of an adjacent mesh.

Problem of the Prior Art

Disadvantageously, the shape of the mesh elements and their coupling mechanism make the assembly, coupling and possible replacement, addition or removal of the meshes difficult. Furthermore, the features of the ornamental item do not allow an easy rotation of the meshes around the circumferential axis so as to pass to a different configuration.

SUMMARY OF THE INVENTION

In this context, the technical task underlying the present invention is to propose an extensible ornamental item which has an alternative solution related to the coupling mechanism between male element and female element.

In particular, it is an object of the present invention to provide an extensible ornamental item which has structural and functional features capable of allowing an integral rotation movement of all the meshes forming the ornamental item.

The technical task mentioned, and the objects stated are substantially achieved by an extensible ornamental item comprising the technical features set out in one or more of the appended claims.

BRIEF DESCRIPTION OF THE DRAWINGS

Further features and advantages of the present invention will become more apparent from the description of an exemplary, but not exclusive, and therefore non-limiting preferred embodiment of an extensible ornamental item, as illustrated in the appended drawings, in which.

DETAILED DESCRIPTION

Figure 1A:
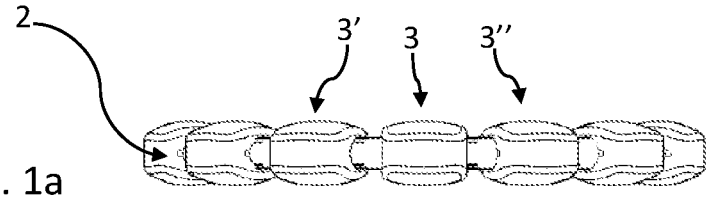
FIG. 1*a* shows a side view of an extensible ornamental item in a first configuration.

With reference to the mentioned figures, number 1 generally indicates an extensible ornamental item in accordance with the present invention.

Such an ornamental item 1 is wearable for example on the wrist, finger, ankle, neck, and ear and can be a bracelet, a ring, a necklace or an earring.

In particular, the ornamental item 1 object of the present invention is of the extensible type and is therefore configured to automatically adapt to the physiognomy of the wrist, finger or neck or ankle.

The extensible ornamental item 1 comprises an annular element 2 formed by a plurality of meshes 3 arranged adjacent to each other along a circumferential direction A-A.

Passing inside each mesh 3, an elastic ring 4 is present along the circumferential direction A-A. Such an elastic ring 4 has a closing area which is closed after the elastic ring 4 has passed inside the meshes 3.

The assembly of the ornamental item 1 is finally completed once the last two meshes 3 are mutually coupled around the previously closed elastic ring 4.

It should be noted that the number of meshes 3 can be varied to adapt the ornamental item to the wrist size of the person wearing it.

The extensible ornamental item 1 is made of metallic material, preferably gold.

In a preferred embodiment, the elastic ring 4 is formed by a spiral spring made of metallic material. Alternatively, the elastic ring 4 can be made of elastomeric material. Thanks to its elastic properties, the elastic ring 4 can, at first, expand in a radial direction so as to allow the user to wear the ornamental item 1, and then constrict until it adapts to the diameter of the user's wrist.

Each mesh 3 is coupled on opposite sides to an adjacent mesh, hereinafter referred to with 3' and 3", in a mutually movable manner along the circumferential direction A-A.

Each mesh 3 has a female element 7 at a first end portion 6*a* and a male element 5 at a second end portion 6*b* opposite the first end portion 6*a*.

The female element 7 and the male element 5 of each mesh, in the example the mesh 3, are constrained in a mutually movable manner to the male element 5' and to the female element 7", respectively, of the two adjacent meshes 3', 3" arranged on opposite sides of the mesh 3.

Thereby, a male-female and female-male coupling is obtained for each mesh 3 with the respective adjacent meshes 3', 3" which allows a movement of mutual distancing and approach between the meshes 3 following an expansion and constriction of the elastic ring 4.

Each male element 5 comprises a tubular body 8 extending along a longitudinal direction B-B between a first opening 9*a* and a second opening 9*b*. Each tubular body 8 defines the shape of the male element 5 and together with the coupling mechanism with the female element 7, which will be addressed later in the present disclosure, allows the integral rotation of the entire annular element 2 around the circumferential axis A-A.

Each tubular body 8 comprises a first pair of flaps 10 placed at the first opening 9*a* and a second pair of flaps 10 placed at the second opening 9*b*.

Each flap 10 can be made of metallic material such as gold, silver or platinum. Alternatively in harmonic steel, plastic material or other material with elastic return properties.

In particular, each flap 10 comprises a slot 11 of elliptical shape extending along the longitudinal direction B-B. Furthermore, each flap 10 is obtained on the tubular body 8 by a pair of opposing notches 17 with respect to the corresponding slot 10, which extend along the longitudinal direction B-B starting from the opening 9*a* of the male element 5.

With this configuration each flap 10 has a movable distal end 15*a*, at the opening 9*a* of the tubular body 8, which can be displaced with respect to the tubular body 8 and a fixed proximal end 15*b* which remains constrained to the tubular body 8.

Each female element 7 comprises a central body 12 and a circular hole 13 passing inside the central body 12 between a first circular opening 14*a* and a second circular opening 14*b*, opposite the first circular opening 14*a* along the longitudinal direction B-B. Each female element 7 further comprises two concave faces 16*a*, 16*b* separated from each other by the central body 12.

At each first circular opening 14*a* and each second circular opening 14*b* there are a pair of opposing pins 15 of cylindrical shape and arranged mutually facing radially projecting, inside the circular hole 13.

The shape coupling between the male element 5 and the female element 7 occurs by displacing each flap 10 towards the inside of the tubular body 8, at the relative distal end 15*a*, in order to insert the respective pin 15 of the female element 7 inside the corresponding slot 11.

Once the pin 15 has been inserted in the respective slot 11, the flap 10 is returned to the position preceding the displacement, deforming the flap 10 if it is made of metal such as gold, silver or platinum. Alternatively, if the flap 10 were made of material with elastic return properties, the flap 10 would independently return to the position preceding the displacement.

Thereby, the elliptical extension of the slot 10 along the longitudinal direction B-B defines a clearance between the male element 5 and the female element 7 in which the pin 15 of the female element 7 can slide inside the slot 10 in relation to an expansion or constriction of the elastic ring 4 of the ornamental item 1.

Figure 1B:
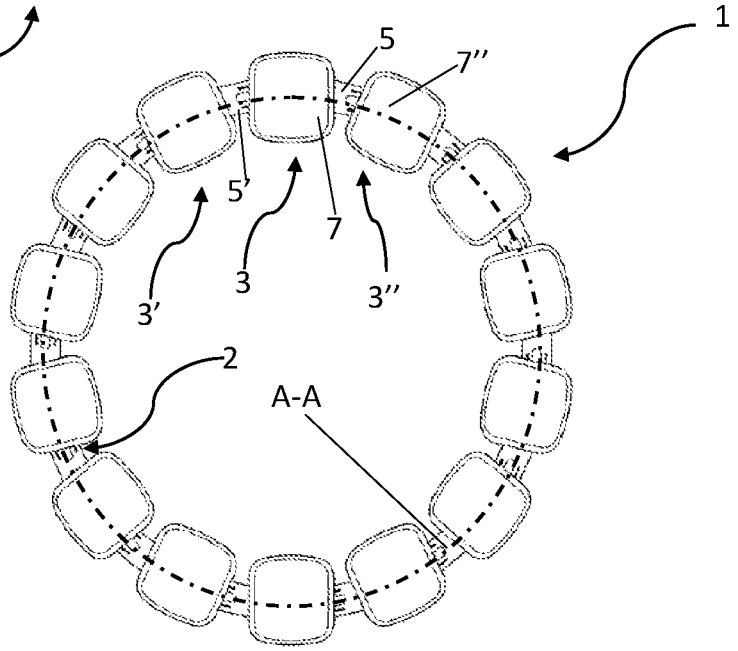
FIG. 1*b* shows a top view of the extensible ornamental item of FIG. 1*a* in the first configuration.
Figure 1C:
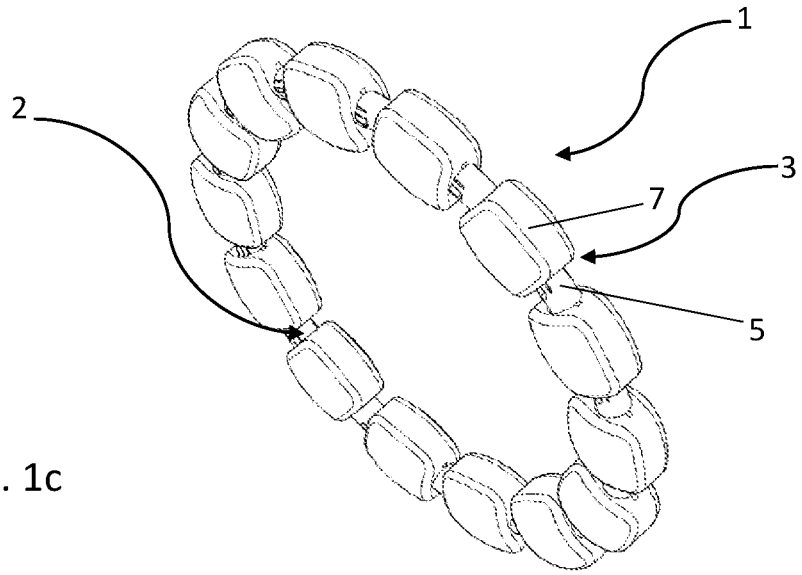
FIG. 1*c* shows a perspective view of the extensible ornamental item of FIGS. 1*a* and 1*b* in the first configuration.
Figure 2A:
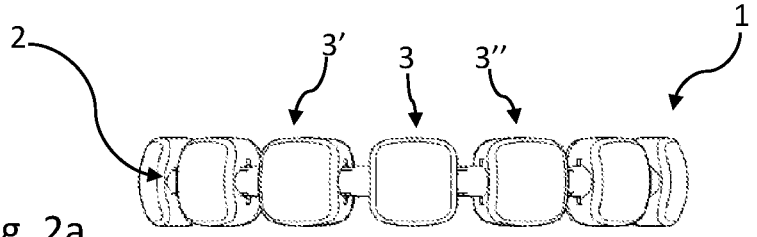
FIG. 2*a* shows a top view of an extensible ornamental item in a second configuration.
Figure 2B:
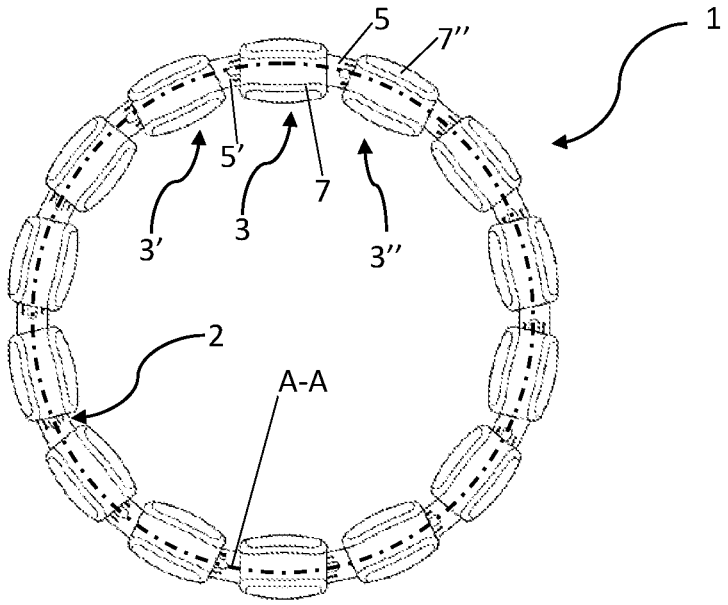
FIG. 2*b* shows a side view of the extensible ornamental item of FIG. 2*a* in the second configuration.
Figure 2C:
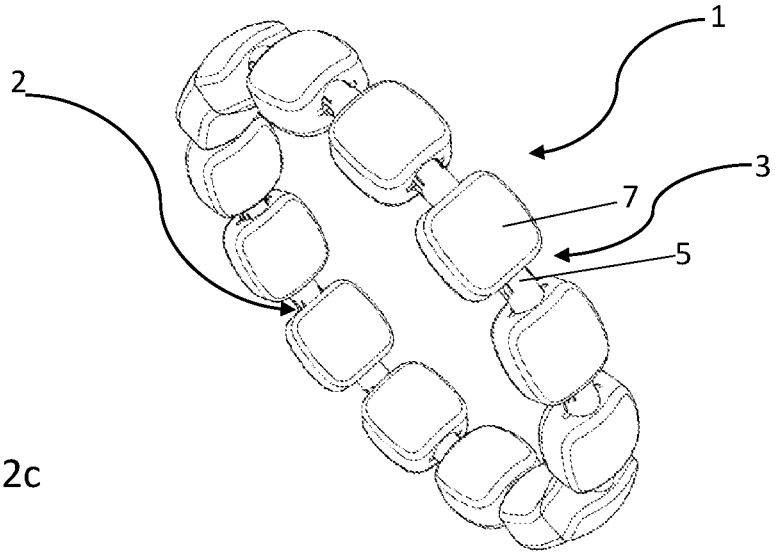
FIG. 2*c* shows a perspective view of the extensible ornamental item of FIGS. 1*a* and 1*b* in the second configuration.
Figure 3:
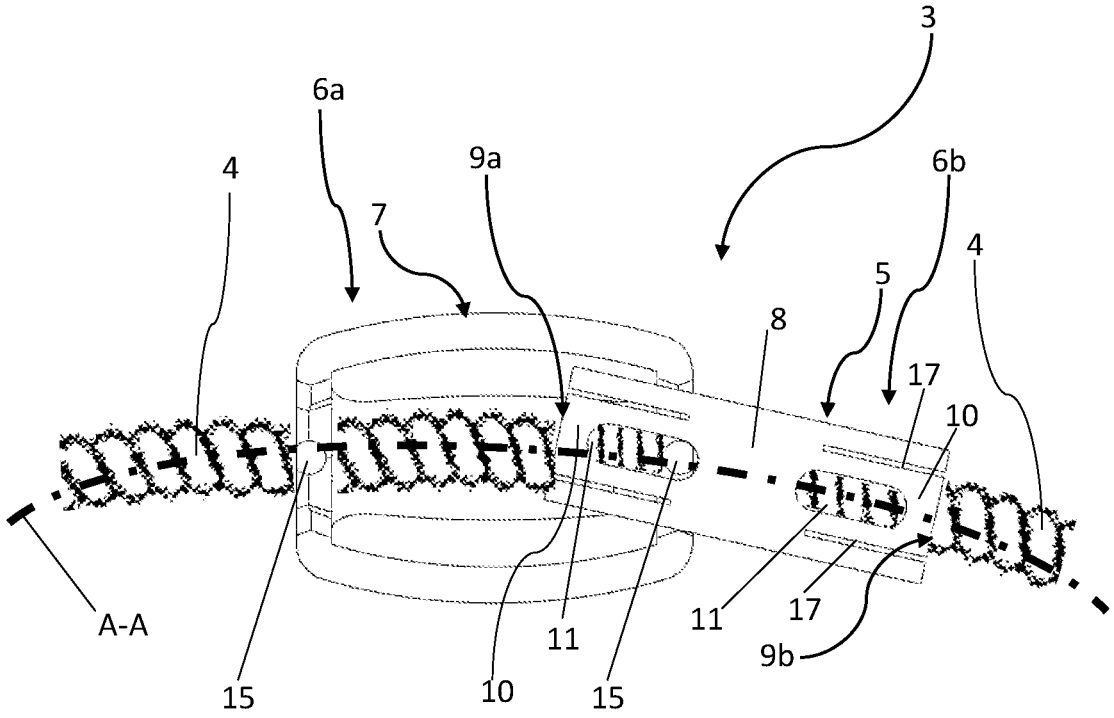
FIG. 3 shows a side view of a mesh of an extensible ornamental item with coupled elements mounted on the elastic ring.
Figure 4:
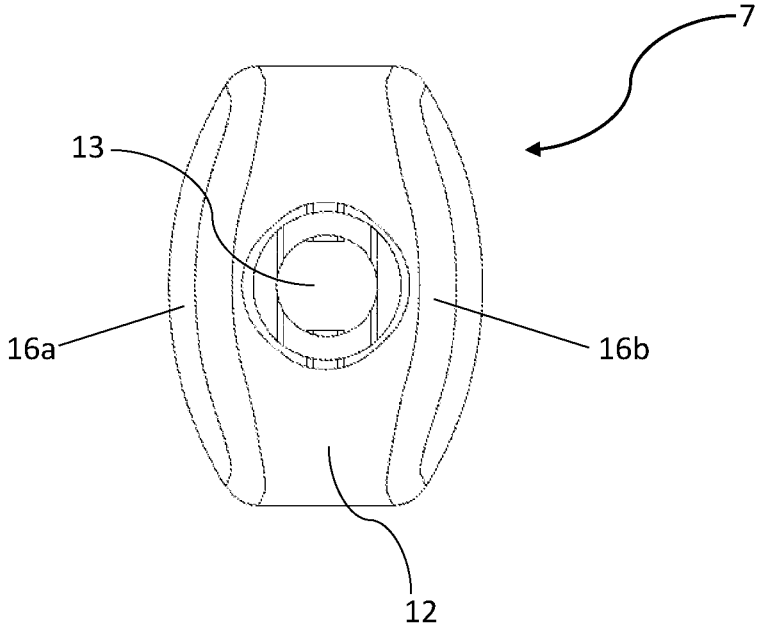
FIG. 4 shows a sectional view of a mesh of an extensible ornamental item with coupled elements.
Figure 5A:
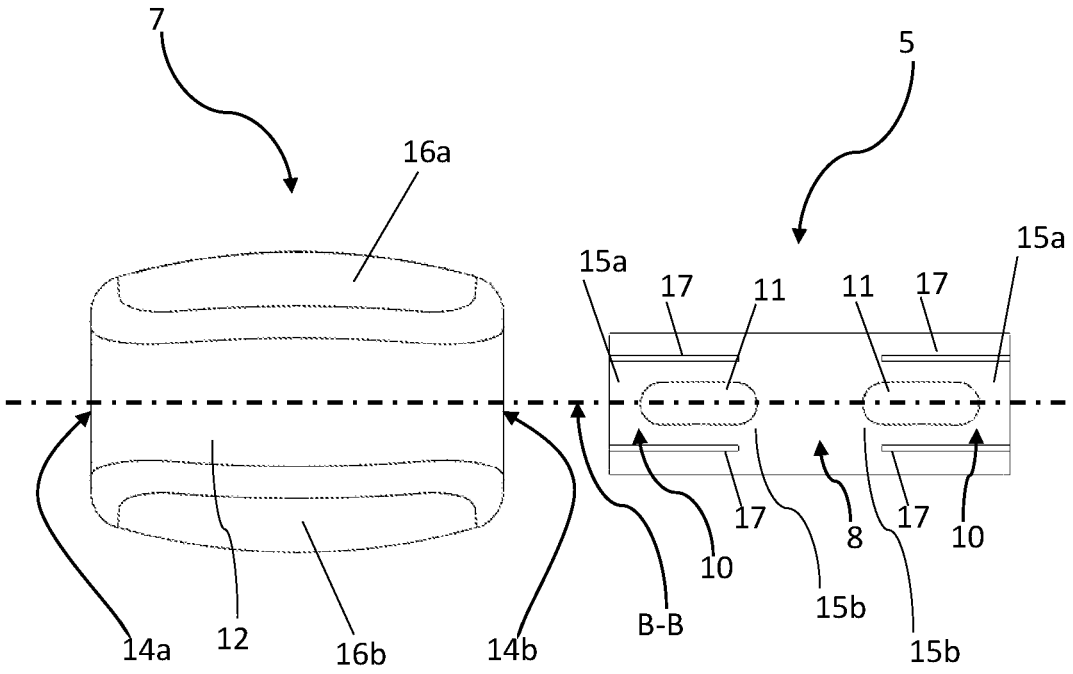
FIG. 5*a* shows a side view of a mesh of an extensible ornamental item with separate elements in a first configuration.
Figure 5B:
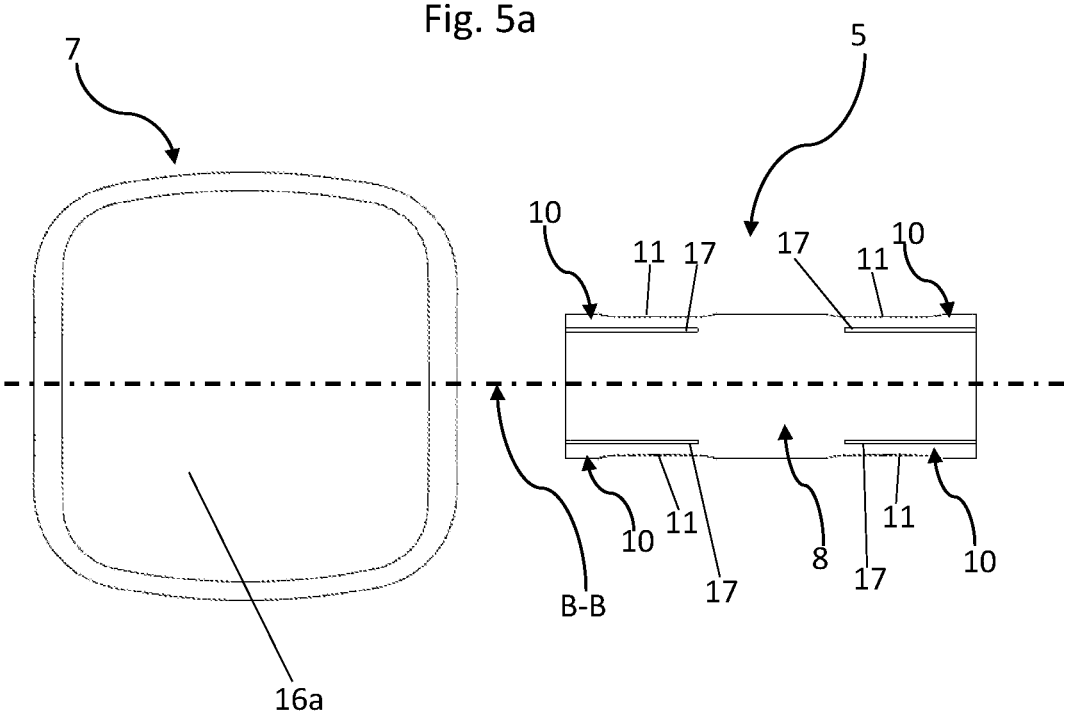
FIG. 5*b* shows a side view of a mesh of an extensible ornamental item with separate elements in a second configuration.
Figure 6A:
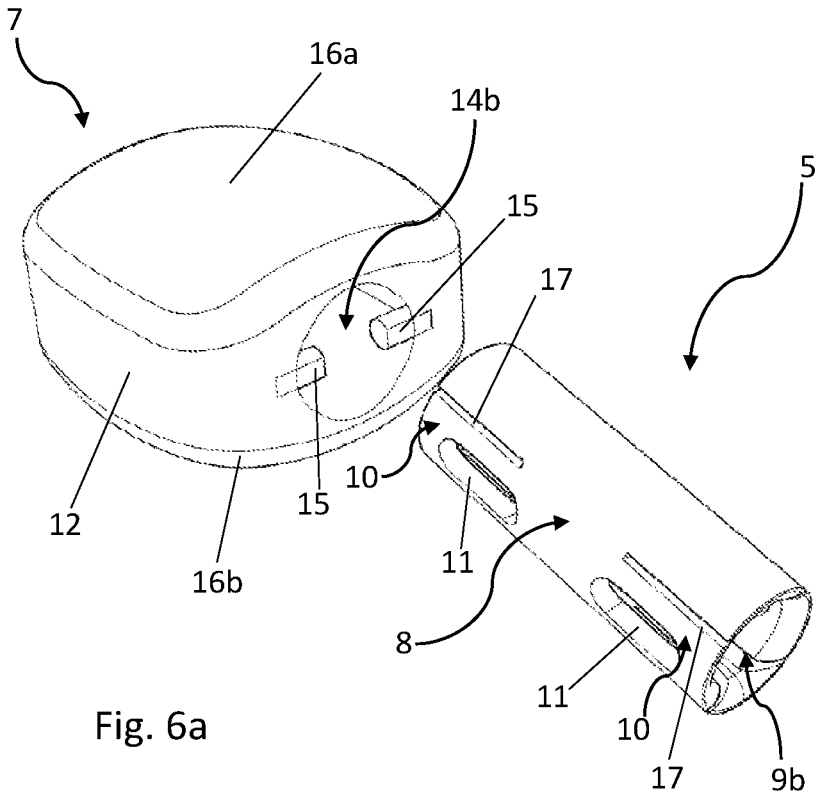
FIG. 6*a* shows a perspective view of a mesh of an extensible ornamental item with separate elements in a first configuration.
Figure 6B:
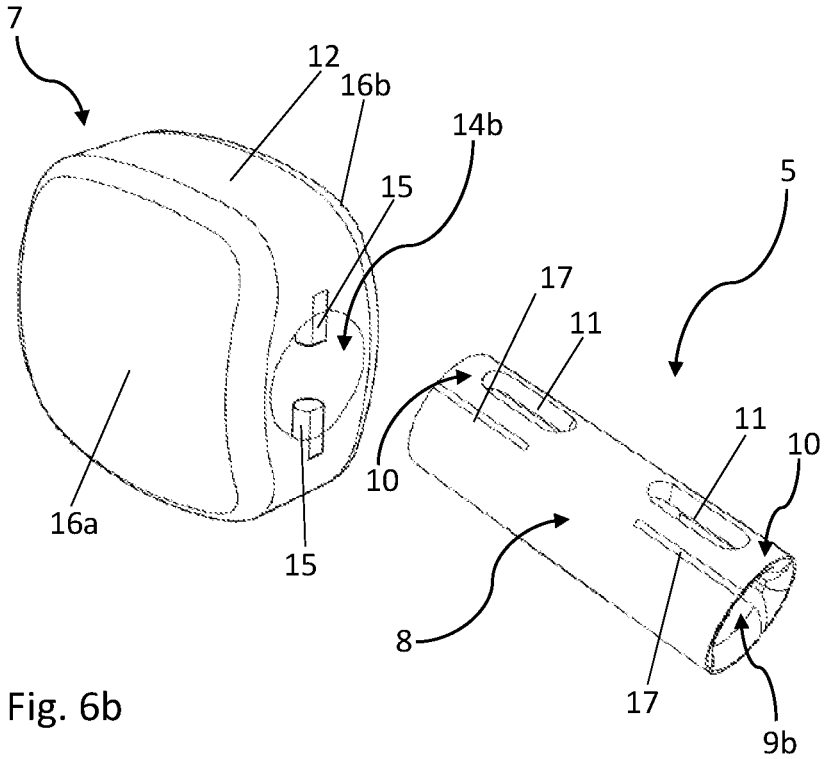
FIG. 6*b* shows a perspective view of a mesh of an extensible ornamental item with separate elements in a second configuration.

Advantageously, this coupling mechanism between the elements of the ornamental item 1 allows the user to be able to jointly rotate all the meshes 3 with a single rotation movement around the circumferential axis A-A. For example, FIGS. 1*a*, 1*b* and 1*c* show a first configuration of the ornamental item 1 in which the elements have been rotated by 90°, starting from a second configuration of the ornamental item 1 shown in FIGS. 2*a*, 2*b* and 2*c*.

The faces 16*a*, 16*b* of the female element 7 are made of metallic material and, preferably, can be aesthetically different. Thereby the user, by making a 180° rotation of the elements of the ornamental item 1, can switch from a first aesthetic configuration in which the face 16*a* is exposed outwards, to a second aesthetic configuration in which the face 16*b* is exposed outwards.

The invention claimed is:

1. Extensible ornamental item comprising:

an annular element formed by a plurality of meshes arranged adjacent to each other along a circumferential direction, an elastic ring mounted passing through each mesh along said circumferential direction, wherein:

each mesh is coupled to an adjacent mesh in a mutually movable manner along a circumferential direction, each mesh comprises a female element at a first end portion and a male element at a second end portion opposite the first end portion, the female element and the male element are constrained in a mutually movable manner with respect to the male element of the mesh and to the female element of the adjacent mesh, characterised in that:

each male element comprises a tubular body extending along a longitudinal direction between a first opening provided with a first pair of opposing flaps and a second opening, opposite the first opening, provided with a second pair of opposing flaps, each flap comprises a respective slot extending along the longitudinal direction, each female element comprises a central body and a circular hole passing through said central body between a first circular opening provided with a first pair of opposing pins and a second circular opening, opposite the first circular opening along the longitudinal direction, provided with a second pair of opposing pins, each pin of the first pair of opposing pins of the female element of a first mesh is adapted to engage in the respective slot of each flap of the first pair of opposing flaps of the male element of the first mesh, each pin of the second pair of opposing pins of the female element of the first mesh is adapted to engage in the respective slot of each flap of the second pair of opposing flaps of the male element of a second mesh, adjacent to the first mesh, each respective slot of each flap of the second pair of opposing flaps of the male element of the first mesh is further adapted to engage each pin of a second pair of opposing pins of the female element of a third mesh, adjacent to the first mesh and opposite to the second mesh with respect to the first mesh, whereby upon coupling a first mesh to an adjacent second mesh, a male-female coupling and a female-male coupling are obtained which thereby enable movement and distancing between the first and second meshes.

2. Extendable ornamental item according to claim 1, wherein each slot extends elliptically along the longitudinal direction.

3. Extensible ornamental item according to claim 2, wherein each flap is delimited on the tubular body by a pair of notches, opposed with respect to the respective slot, which extend along the longitudinal direction starting from the respective opening of the male element.

4. Extendable ornamental item according to claim 1, wherein the male element of each mesh obtains a shape coupling with a respective female element of the adjacent mesh.

5. Extendable ornamental item according to claim 1, wherein the first and second pair of pins of each female element have a cylindrical shape, are arranged mutually facing and radially projecting at the circular opening inside the circular hole.

6. Extensible ornamental item according to claim 1, wherein each first and second pair of opposing flaps has a movable distal end which can be displaced with respect to the tubular body and a fixed proximal end which remains constrained to the tubular body.

7. Extendable ornamental item according to claim 1, wherein the male element is made of metallic material.

8. Extensible ornamental item according to claim 1, wherein each female element comprises two concave faces separated from each other by the central body.

9. Extendable ornamental item according to claim 8, wherein the two concave faces of the female element are made of metallic material.

10. Extensible ornamental item according to claim 9, wherein said two concave faces of the central body of the female element can be aesthetically different.

* * * * *